US008734015B2

(12) United States Patent
Futase

(10) Patent No.: US 8,734,015 B2
(45) Date of Patent: May 27, 2014

(54) FLEXIBLE PACKAGE BAG PROVIDED WITH ONE-WAY FUNCTIONING NOZZLE AND PACKAGING STRUCTURE FOR LIQUID MATERIAL

(75) Inventor: Katsunori Futase, Niigata (JP)

(73) Assignee: Yushin Co., Ltd., Niigata (JP)

( * ) Notice: Subject to any disclaimer, the term of this patent is extended or adjusted under 35 U.S.C. 154(b) by 410 days.

(21) Appl. No.: 12/682,259

(22) PCT Filed: Jun. 15, 2009

(86) PCT No.: PCT/JP2009/061264

§ 371 (c)(1),
(2), (4) Date: Apr. 9, 2010

(87) PCT Pub. No.: WO2010/004853

PCT Pub. Date: Jan. 14, 2010

(65) Prior Publication Data

US 2010/0209025 A1 Aug. 19, 2010

(30) Foreign Application Priority Data

Jul. 11, 2008 (JP) ..... 2008-181395

(51) Int. Cl.

| | |
|---|---|
| ***B65D 30/24*** | (2006.01) |
| ***B65D 33/00*** | (2006.01) |
| ***B65D 30/16*** | (2006.01) |
| ***B65D 30/08*** | (2006.01) |

(52) U.S. Cl.

USPC ..... 383/44; 383/207; 383/104; 383/113; 383/116; 383/906

(58) Field of Classification Search

USPC ..... 383/113, 116, 104, 119, 906, 210, 61.1, 383/44, 207

See application file for complete search history.

(56) References Cited

U.S. PATENT DOCUMENTS 4,131,200 A * 12/1978 Rinfret ..... 206/484
5,885,740 A 3/1999 Tokunaga et al.

(Continued)

FOREIGN PATENT DOCUMENTS

EP 1783061 A1 * 5/2007 ..... B65D 75/58
GB 756346 9/1956

(Continued)

OTHER PUBLICATIONS

Machine translation of Japanese Document No. 2007-326581. Translated on Jul. 22, 2013.*

(Continued)

*Primary Examiner* — Jes F Pascua

(74) *Attorney, Agent, or Firm* — Greenblum & Bernstein P.L.C.

(57) ABSTRACT

There is proposed a non-self supporting type flexible package bag provided with a film-shaped one-way pouring nozzle, which is excellent in not only the non-return function and liquid cutting properties but also the pouring property of a liquid packed material as a filling material (packed material in the bag can be poured smoothly until the end). In the flexible package bag provided with the film-shaped one-way pouring nozzle protruding from a side portion, corner portion or top portion of the package bag body, a coating layer made from a water-repellent material or an oil-repellent material is provided on an outer surface of the film-shaped one-way pouring nozzle, while a wet-treated layer is provided on an inner face of a pouring path in the film-shaped one-way pouring nozzle.

6 Claims, 5 Drawing Sheets

(56) References Cited

U.S. PATENT DOCUMENTS

| | | | |
|---|---|---|---|
| 6,732,889 | B2 | 5/2004 | Oren et al. |
| 2002/0141664 | A1 | 10/2002 | Matsuda et al. |
| 2008/0264970 | A1 | 10/2008 | Kasai |

FOREIGN PATENT DOCUMENTS

| | | | | |
|---|---|---|---|---|
| JP | 45-2227 | | 1/1970 | |
| JP | 58-074525 | | 5/1983 | |
| JP | 3-289451 | | 12/1991 | |
| JP | 04-053644 | | 5/1992 | |
| JP | 4-53644 | | 5/1992 | |
| JP | 05-294350 | | 11/1993 | |
| JP | 6-156512 | | 6/1994 | |
| JP | 06-156512 | | 6/1994 | |
| JP | 8-173298 | | 7/1996 | |
| JP | 8-282687 | | 10/1996 | |
| JP | 8-324585 | | 12/1996 | |
| JP | 9-112721 | | 5/1997 | |
| JP | 10-101339 | | 4/1998 | |
| JP | 11-001249 | | 1/1999 | |
| JP | 11-049234 | | 2/1999 | |
| JP | 11-059728 | | 3/1999 | |
| JP | 11-222262 | | 8/1999 | |
| JP | 2000-072152 | | 3/2000 | |
| JP | 2000-177755 | | 6/2000 | |
| JP | 2000-281091 | | 10/2000 | |
| JP | 2001-048198 | | 2/2001 | |
| JP | 2001-063760 | | 3/2001 | |
| JP | 2001-192068 | | 7/2001 | |
| JP | 2001-261065 | | 9/2001 | |
| JP | 2001-341755 | | 12/2001 | |
| JP | 2002-205763 | | 7/2002 | |
| JP | 2002-362591 | | 12/2002 | |
| JP | 2003-237838 | | 8/2003 | |
| JP | 2003-267446 | | 9/2003 | |
| JP | 2004-019634 | | 1/2004 | |
| JP | 2004-175434 | | 6/2004 | |
| JP | 2004-175439 | | 6/2004 | |
| JP | 2004-196364 | | 7/2004 | |
| JP | 2004-238004 | | 8/2004 | |
| JP | 2005-15029 | | 1/2005 | |
| JP | 2005015029 | A * | 1/2005 | ..... B65D 33/38 |
| JP | 2005-59958 | | 3/2005 | |
| JP | 2006199346 | A * | 8/2006 | |
| JP | 2006-264698 | | 10/2006 | |
| JP | 2007-326581 | | 12/2007 | |
| JP | 2008-012669 | | 1/2008 | |
| WO | 2006/011247 | | 2/2006 | |
| WO | 2009/020226 | | 2/2009 | |
| WO | 2009/069514 | | 6/2009 | |
| WO | 2009/078196 | | 6/2009 | |
| WO | 2009/139299 | | 11/2009 | |
| WO | 2010/010772 | | 1/2010 | |

OTHER PUBLICATIONS

Search report from E.P.O., mail date is Jul. 8, 2011.

U.S. Appl. No. 12/593,477 to Katsunori Futase, filed Sep. 28, 2009.

Korea Office action, dated May 11, 2011 along with an english translation thereof.

U.S. Appl. No. 12/593,477, filed Sep. 28, 2009.

U.S. Appl. No. 12/682,259, filed Apr. 9, 2010.

Japan Office action, mail date is Oct. 23, 2012.

* cited by examiner

FLEXIBLE PACKAGE BAG PROVIDED WITH ONE-WAY FUNCTIONING NOZZLE AND PACKAGING STRUCTURE FOR LIQUID MATERIAL

TECHNICAL FIELD

This invention relates to a flexible package bag provided with a protrusion of a film-shaped one-way pouring nozzle (liquid pouring nozzle) having a self-sealing non-return function and made from a pair of front and rear overlapping plastic films each having a laminate film structure as well as a liquid-filled packaging structure in which a non-self supporting type liquid-filled packaging body formed by packing various kinds of liquids and the like in the above flexible package bag at a deaeration state, for example, through an in-liquid seal-packing or the like is housed in a self-supporting type outer package bag.

The term "in-liquid seal-packing" used herein means that a package bag body filled with a liquid is subjected to a sealing so as to squeeze the liquid from the resulting sealed portion without incorporating a gas such as air, nitrogen gas or the like into the interior of the package bag.

BACKGROUND ART

As a flexible package bag provided with a liquid pouring nozzle of a self-sealing non-return function made from plastic films or a film-shaped one-way pouring nozzle, there are bags as disclosed in JP-A-2005-15029 and JP-A-2005-59958 proposed by the inventors. Since these flexible package bags are non-self supporting type package bags made from soft laminate films, they are inconvenient in use alone as they are and have taken a form of housing and fixing in a container as disclosed in JP-A-2004-196364.

DISCLOSURE OF THE INVENTION

Problems to be Solved by the Invention

The package bags disclosed in JP-A-2005-15029 and JP-A-2005-59958 are used as a liquid-filled packaging body in which only a liquid packing material is substantially included by packing a liquid seasoning such as soy sauce or the like or a liquid substance such as salad oil or the like through, for example, in-liquid seal-packing.

Also, the liquid-filled packaging body has a characteristic that the liquid packing material does not quite contact with air inside the package bag even when the liquid packing material is poured. Therefore, the liquid packing material hermetically encapsulated in the package bag has a merit that the original state can be maintained over a long time of period because chemical change due to oxidation or the like does not occur.

In the above film-shaped one-way pouring nozzle, the front and rear plastic films are closed to each other based on the wetting with the packing material to develop self-sealing non-return function, but there are problems that the non-return function is sometimes affected by the film strength (nerve) at the side of the package bag body or that the non-return function is deteriorated due to the lowering of capillary action in the film-shaped one-way pouring nozzle and also that the liquid-cutting in the pouring is deteriorated to cause dripping.

Also, the conventional packaging structure disclosed in JP-A-2004-196364 has a problem that since it is required to place the non-self supporting type flexible package bag filled with the packing material into a paper box and fasten thereto, the production steps including the boxing are cumbersome and the cost becomes higher.

It is, therefore, an object of the invention to solve the aforementioned problems inherent to the conventional techniques and to propose a non-self supporting type flexible package bag particularly provided with a film-shaped one-way pouring nozzle having excellent non-return functioning property and liquid cutting property.

It is another object of the invention to propose a liquid-filled packaging structure capable of maintaining the non-self supporting type flexible package bag at a use state as it is.

Means for Solving Problems

The inventors have made various studies in order to achieve the above objects and discovered an inventive construction having the following summary and constitutions. That is, the invention proposes a flexible package bag comprising a package bag body formed by seal-joining front-side and rear-side soft laminate films, and a film-shaped one-way pouring nozzle protruded from any position of a side portion, a corner portion and a top portion of the package bag body and formed by closing a pair of overlapping plastic films to each other in the presence of a liquid packing material, characterized in that a coating layer made from a water-repellent material or an oil-repellent material is provided on an outer surface of the film-shaped one-way pouring nozzle, while a wet-treated layer is provided on an inner surface of a pouring path in the film-shaped one-way pouring nozzle.

In the flexible package bag according to the invention, more preferable embodiments are as follows:

(1) The film-shaped one-way pouring nozzle is formed by fusing a pair of overlapping soft plastic films to each other at a peripheral edge portion other than a portion corresponding to a base end portion of the nozzle so as to constitute a central portion of the nozzle as a pouring path and integrally uniting with the main body of the package bag, and generates a non-return function blocking penetration of air by a closing action between mutual inner surfaces of the plastic films based on a fact that when the package bag body is tilted to pour a liquid packing material, the pouring path is rendered into a wet state due to the passing of the liquid packing material to attach the liquid packing material to the inner surface of the pouring path;

(2) The film-shaped one-way pouring nozzle is formed by fusing a pair of overlapping soft plastic films to each other at a peripheral edge portion other than a portion corresponding to a base end portion of the nozzle so as to constitute a central portion of the nozzle as a pouring path and fusion-joining the base end portion of the nozzle to a side portion of the main body of the package bag, with a non-return function blocking penetration of air generated by a closing action between mutual inner surfaces of the plastic films when the package bag body being tilted to pour a liquid packing material, and the pouring path being rendered into a wet state by the liquid packing material passing through the path to attach the liquid packing material to the inner surface of the pouring path;

(3) At the base end portion of the film-shaped one-way pouring nozzle, opposite sealant layers of the overlapping plastic films are temporarily fused at a lower temperature to temporarily seal the inner surface of the pouring path; and (4) The coating layer made from a water-repellent material or an oil-repellent material and the wet-treated layer are arranged at least in a predetermined opening position of the film-shaped one-way pouring nozzle and a vicinity of the predetermined opening position.

Furthermore, the invention lies in a liquid-filled packaging structure comprising a non-self supporting type liquid-filled packaging body formed by deaeration-packing a liquid or viscous packing material into a non-self supporting type flexible package bag comprised of a package bag body formed by seal joining front-side and rear-side soft laminate films and a film-shaped one-way pouring nozzle protruded from any position of a side portion, a corner portion and a top portion of the package bag body and formed by closing a pair of overlapping plastic films to each other in the presence of a liquid packing material, and a self-supporting type outer cylindrical package bag for housing the non-self supporting type liquid-filled packaging body which is provided at its one-side portion with tear-guide perforations for nozzle opening for exposing a tip portion of the film-shaped one-way pouring nozzle.

In the liquid-filled packaging structure, more preferable embodiments are as follows:

(1) The film-shaped one-way pouring nozzle is provided on its outer surface with a coating layer made from a water-repellent material or an oil-repellent material and on its inner surface being a pouring path with a wet-treated layer;

(2) The film-shaped one-way pouring nozzle is formed by fusing a pair of overlapping soft plastic films to each other at a peripheral edge portion other than a portion corresponding to a base end portion of the nozzle so as to constitute a central portion of the nozzle as a pouring path and is integrally united with the main body of the package bag, with a non-return function blocking penetration of air generated by a closing action between mutual inner surfaces of the plastic films when the package bag body being tilted to pour a liquid packing material, and the pouring path being rendered into a wet state by the liquid packing material passing through the path to attach the liquid packing material to the inner surface of the pouring path;

(3) The film-shaped one-way pouring nozzle is formed by fusing a pair of overlapping soft plastic films to each other at a peripheral edge portion other than a portion corresponding to a base end portion of the nozzle so as to constitute a central portion of the nozzle as a pouring path and fusion-joining the base end portion of the nozzle to a side portion of the main body of the package bag, with a non-return function blocking penetration of air generated by a closing action between mutual inner surfaces of the plastic films when the package bag body being tilted to pour a liquid packing material, and the pouring path being rendered into a wet state by the liquid packing material passing through the path to attach the liquid packing material to the inner surface of the pouring path;

(4) At the base end portion of the film-shaped one-way pouring nozzle, opposite sealant layers of the overlapping plastic films are temporarily fused at a lower temperature to temporarily seal the inner surface of the pouring path;

(5) The coating layer made from a water-repellent material or an oil-repellent material and the wet-treated layer are arranged at least in a predetermined opening position of the film-shaped one-way pouring nozzle and a vicinity of the predetermined opening position; and (6) The non-self supporting liquid-filled packaging body is housed and kept in the self-supporting type outer package bag at a suspended state by fusing a horizontal seal portion at an upper end part of the packaging body to an upper end portion of the outer package bag.

Effect of the Invention

According to the invention, by adopting a novel construction in the flexible package bag provided with a one-way pouring nozzle or a film-shaped one-way pouring nozzle having a self-sealing non-return function, quality-deteriorating factors such as oxidation of a packing material filled through in-liquid seal-packing (which is basically packed so as to be only a liquid packing material at a gas-less state) and the like can be removed and back-flowing of air and the like into the bag (air flows into the package bag instead of pouring the packing material) can be also surely prevented even after the film-shaped one-way pouring nozzle is torn at a given position (the package bag is opened), and hence the packing material retaining in the bag can be kept at a fresh state over a long time.

Also, according to the invention, the coating layer made from a water-repellent material or an oil-repellent material is disposed on the outer surface of the one-way pouring nozzle and the wet-treated layer is disposed on the inner surface of the pouring path, whereby the dripping after the pouring of the packing material can be effectively prevented because at least the tear-opened portion of the film-shaped one-way pouring nozzle (pouring port) is excellent in the water repellency and oil repellency, and hence the hand and fingers of the user are never stained.

Furthermore, the temporary sealing structure is adopted in the inner surface of the base end portion of the nozzle by the temporary fusing treatment at a lower temperature, so that the non-return functioning property is not blocked by handling or the like.

According to the invention, the non-self supporting type liquid-filled packaging body formed by deaeration-packing a liquid material into the non-self supporting type flexible package bag through the in-liquid seal-packing is housed in an outer package bag such as a self-supporting type flexible package bag made from a soft laminate film (standing pouch: outer bag) preferably at a state capable of exchanging the used bag with a new bag without placing into a hard package, whereby the packaging body can be applied to a use form as it is and the pouring of the liquid packing material can be also stabilized.

Also, according to the invention, the film-shaped one-way pouring nozzle can be integrally united with the flexible package bag body, which is simple in the production and contributes to the reduction of the production cost.

EMBODIMENTS OF THE INVENTION

Figure 1:
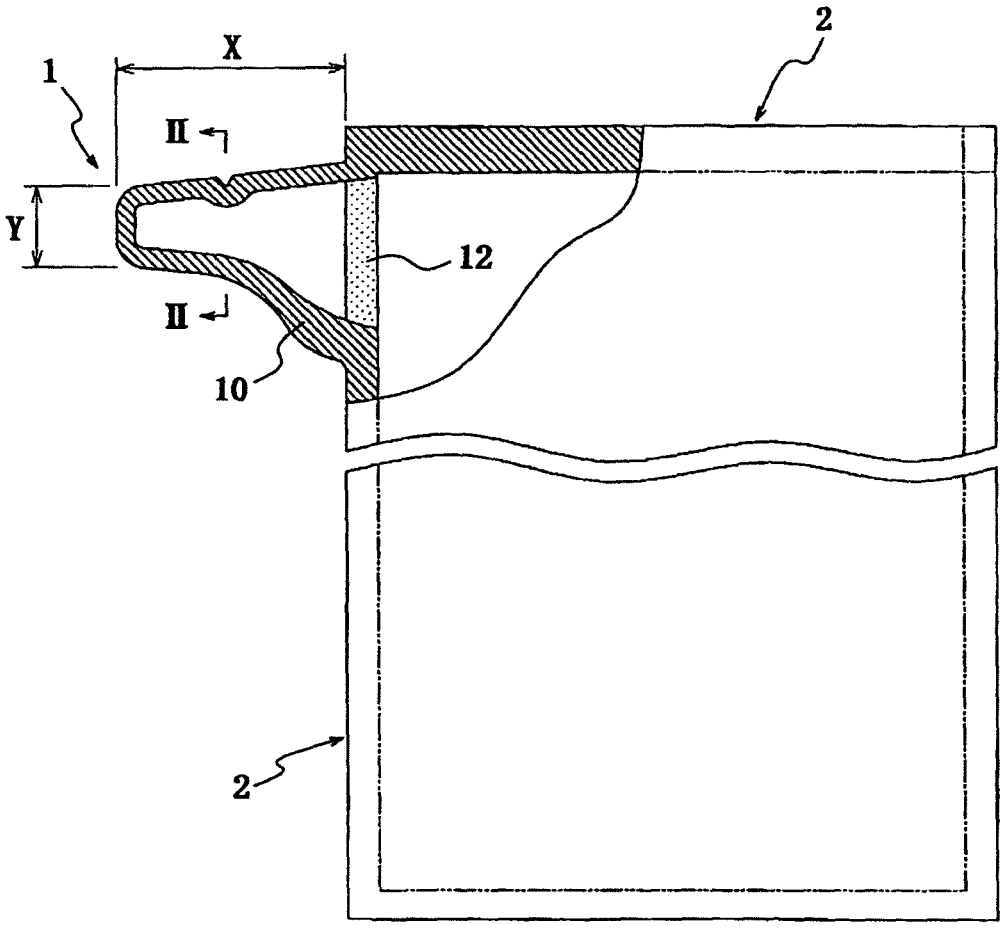
FIG. 1 is a front view illustrating an embodiment of the flexible package bag according to the invention.

The flexible package bag according to the invention comprises a package bag body made from a soft laminate film having, for example, two or three layer laminate structure and a film-shaped one-way pouring nozzle (liquid pouring nozzle as disclosed in JP-A-2005-59958) fused at any position of an upper part, a corner part and a top part of either side edge portion of the body at a state of protruding from the body in a transverse direction, an obliquely upward direction, an upper direction or the like or previously united integrally with the package bag body and formed by oppositely superposing two soft and thin plastic films (pair of front and rear films) each made basically of two or three layers. Moreover, the pouring path formed between two superposed films (opposed front and rear sides) in the film-shaped one-way pouring nozzle is closed due to the interposition of the liquid material attached by the capillary action, whereby the non-return function is developed.

The film-shaped one-way pouring nozzle being a characteristic construction in the flexible package bag according to the invention is constituted, for example, by fusion-joining a nozzle base end portion to an inner surface of an upper side portion (sealant layer) of the package bag body through a sealant layer as an outermost layer of the plastic film constituting the nozzle to communicate the pouring path disposed in the central portion of the pouring nozzle with the inside of the bag body.

For example, the pouring nozzle is formed by fusion-bonding front-side and rear-side plastic films each comprising a uniaxially or biaxially oriented base film layer and inner and outer sealant layers sandwiching the base film layer from front and rear sides, for example, opposite sealant layers in the pair of the plastic films or opposed sealant layers of the single plastic film folded in a half width at a peripheral portion other than a base end portion with each other in the form of substantially a wedge shape as a whole so as to provide a pouring path with the central portion of the nozzle not being fused.

Such a film-shaped one-way pouring nozzle can be made individually by fusion-bonding peripheral edge portions of sealant layers in the pair of two superposed and laminated plastic films (opposing at front and rear sides), which are suitably made, for example, from polyethylene layer, polypropylene layer, ethylene vinyl alcohol (EVA), ionomer, EVOH or the like, other than a portion being a base end portion so as to provide a desired shape (wedge shape) through heat sealing, high frequency sealing, impulse sealing or the like.

Typically, the film-shaped one-way pouring nozzle has a protruding length from the package bag body X of about 30-100 mm and a nozzle top width (tear opening position) Y of about 20-80 mm. For instance, for the package bag body, films being used vary by the weight of the packing material but a thick and elastic laminate film made of two layers of NY 15 μm/PE 60 μm is generally used, whereas for the film-shaped one-way pouring nozzle, not subjected to loading of the packing material, a thin laminate plastic film having a three layer structure of PE 20 μm/NY 15 μm/PE 20 μm is preferably used. The thinner and the more yielding the nozzle's plastic film is, the better the non-return function is.

The pair of front and rear superposed plastic films provide a higher non-return effect as the flatting property (flatness) becomes higher.

The thus obtained film-shaped one-way pouring nozzle made of the plastic film of at least three layer structure (sealant layer-base film layer-sealant layer) is fusion-joined at a state of protruding from the package bag body by fusion-bonding the sealant layer as an outer surface of the base end portion of the nozzle to the sealant layer (preferably, sealant layer of the same kind film) as an inner surface of an opening portion formed at one side portion of the package bag body made from the soft laminate film (mainly two layers) through heat sealing.

In this way, there is obtained a flexible package bag provided with the film-shaped one-way pouring nozzle protruding outward from an upper part, top part or the like at the side portion of the package bag body.

When the outer surface of the base end portion in the film-shaped one-way pouring nozzle is fusion-joined to the inner surface of the opening portion in the side portion of the package bag body, in order to prevent non-intended mutual fusion between the sealant layers in the inner surface of the film-shaped one-way pouring nozzle, it is preferable that a releasing sheet having a higher melting point or not being thermally fused is inserted into an inside of the base end portion of the nozzle connecting to the pouring path or that the fusing temperatures of the sealant layers at the inner and outer surfaces of the nozzle are made different to each other, for example, by changing materials or by changing extrusion laminating conditions so that the melting point of the sealant layer film in the inner surface of the nozzle is made higher than that of the sealant layer film in the outer surface of the nozzle, or more preferably higher by 20-30° C.

For instance, as the sealant film of inner surface side (rear side) is desirably a film of a thermoplastic resin such as polypropylene, polyethylene or the like and having a melting point higher by about 20° C. than a melting point of the outer surface side (front side) material. Also, as the sealant film of outer surface side (front side) a film capable of heat-sealing at a temperature higher than the heat-sealing temperature of the sealant layer in the package bag body is desirable. This is due to the fact that the heat sealing between the mutual sealant films at the inner surface of the film-shaped one-way pouring nozzle is prevented when the film-shaped one-way pouring nozzle is fusion-joined to the bag body through heat sealing.

At this moment, it is preferable that the packing of a liquid such as soy sauce or the like, a liquid seasoning containing a solid substance such as sesame or the like, soup or other liquid packing material (it is possible to incorporate rather large-sized solids into such a liquid) is conducted at the step of joining (heat-sealing) the film-shaped one-way pouring nozzle to the package bag body or after the joining step.

Such a packing of the liquid material is conducted, for example, by the in-liquid seal-packing (the in-liquid seal-packing is carried out without incorporating air, nitrogen gas or the like) or by discharging gas inside the bag after the filling of the packing material (gasless) to conduct deaeration-packing of sufficiently removing the gas from the inside of the package bag body. Because, the non-return function of the film-shaped one-way pouring nozzle is developed sufficiently to airtightly seal the packing material inside the bag at a deaeration sealed state to thereby prevent oxidation or the like and further the non-return function as mentioned later is more surely developed in the film-shaped one-way pouring nozzle.

This is also true when the film-shaped one-way pouring nozzle is integrally united with the package bag body by using a laminate film of at least two layer structure.

The pouring of the liquid packing material packed in the flexible package bag is carried out by cutting a predetermined opening portion formed in the vicinity of the top end portion of the film-shaped one-way pouring nozzle (top end side from a position of forming tear-guide perforations or notches) with hand and fingers. That is, after the opening of the nozzle, the required pouring of the packed material is conducted by tilting the main body of the liquid-filled packaging body so as to be a downward posture of the nozzle opening (pouring port).

In this case, the film-shaped one-way pouring nozzle made from the soft laminate plastic films separates away toward front and rear sides based on the action of water head pressure of the packed material or pressurization of hand and fingers to a base portion of the liquid-filled packaging body to allow for the pouring of the packed material.

Moreover, when the packed material is poured through the nozzle opening (pouring port) of the film-shaped one-way pouring nozzle, the package bag body made from the soft laminate films does not perform intake of ambient air based on the non-return function inherent to the film-shaped one-way pouring nozzle irrespectively of the pouring of the packed material, so that the package bag body is shrunk or collapses to be deformed by a quantity corresponding to the poured volume.

Thus, the liquid-filled packaging body formed by packing the liquid material into the flexible package bag can pour a required quantity of the packed material from the bag by tilting the pouring nozzle being opened. The pouring of the packed material from the nozzle opening is stopped by restoring the packaging body to the original standing posture. Since the inside of the pouring path in the film-shaped one-way pouring nozzle is at a state wetted with the liquid packed material attached thereto by the stop of the pouring, the opposed plastic films at the inner surface of the pouring nozzle are strongly closed to each other through the capillary action, and hence the nozzle opening disposed on the top end portion of the nozzle is at a closed state, whereby the invasion of ambient air into the inside of the package bag body can be blocked surely.

In the package bag provided with such a film-shaped one-way pouring nozzle, the liquid material packed in the bag is protected at a state of completely blocking ambient air even before, during and after the pouring, whereby the oxidation, contamination and the like of the packed material inside the bag are prevented effectively.

As seen from the above description, the closed adhesion between inner surfaces of the two plastic films constituting the film-shaped one-way pouring nozzle through the capillary action is automatically carried out by restoring the package bag to the standing posture to release the nozzle from the action of the water head pressure to thereby return to the original production form, and further by adsorbing the inner surfaces of the pair of the front and rear films (pouring path) wetted with the packed material to each other under a reduced pressure generated when a part of the packed material in the nozzle flows back to the inside of the package bag body. Such an adhesion is attained more surely when the package bag body, shrunk or collapsing to be deformed with the pouring of the packed material from the package bag, performs more surely a tendency of rendering the inside of the bag body into a reduced pressure based on the elastic restoring force inherent the bag body.

Thus, the film-shaped one-way pouring nozzle develops the excellent self-sealing non-return function through the restoring of the package bag to the standing state and the automatic adhesion sealing of the pouring port as a tear opening of the nozzle (self-sealing) without special operation or the like.

On the other hand, the re-pouring of the packed material is conducted more effectively when the package bag body is tilted as mentioned above, preferably when the base portion of the package bag body is further pressurized, while the pouring can be stopped by the restoring of the package bag to the standing state as mentioned above.

Even in this case, the film-shaped one-way pouring nozzle develops the excellent non-return function based on the automatic adhesion sealing.

As the film construction of the package bag body according to the invention, the base film layer located at the outer surface of the body and the sealant layer located at the inner surface of the body may be the same kind as in the base film layer and sealant layer of the film-shaped one-way pouring nozzle.

However, when the film-shaped one-way pouring nozzle and the package bag body are formed separately, the film construction of the package bag body is different from the film for the nozzle, wherein a middle layer may be interposed between the base film layer and the sealant layer.

Preferably, the sealant layer constituting the inner surface of the package bag body made from the soft laminate film is made from the same resin material as in the outermost sealant layer of the pouring nozzle. Thus, the fusion-joining strength of the pouring nozzle to the package bag body can be enhanced sufficiently.

The sealant layer in each of the film-shaped one-way pouring nozzle made of three or more layer laminated plastic film and the package bag supporting it by fusion as well as the package bag body made of a laminate film of two-layer structure as mentioned later may be laminated onto the base film layer by a fusion-extruding laminate process, a dry laminate process, an extrusion laminate process, a co-extrusion laminate process or the like.

Moreover, when the package bag body is made from a laminate film of two- or three-layer structure, it is preferable that the uniaxially or biaxially oriented base film layer in the laminate film is constituted with a polyethylene terephthalate film layer (PET layer), nylon resin film layer (NY layer) or ethylene vinyl alcohol (EVOH) or the like having a thickness of 8-30 μm.

Also, the sealant layer of the laminate film used in the package bag body may be constituted with a non-oriented PE layer, PP layer, EVA layer, ionomer layer, EVOH layer or the like having a thickness of 10-60 μm.

When the thickness of the base film layer is less than 8 steam impermeability, gas barrier property and the like could be insufficient, while when it exceeds 30 μm, the bending strength of the laminate film is too large, and the adhesion between the inner surfaces in the nozzle could be damaged after the pouring of the packed material is stopped.

On the other hand, when the thickness of the sealant layer is less than 10 μm, the sufficient sealing strength could not be ensured, while when it exceeds 60 μm, the bending strength of the laminate film could be too large. Moreover, the sealant layer may be constituted with two or more layers as long as the thickness of the sealant layer is within the above range in total.

The laminate film used in the package bag body is required to be elastic because a constant quantity of liquid material is filled inside. In the invention, it is preferable that the bending strength per unit width (15 mm), or nerve of the laminate film is about 40-300 mN as a value measured using a nerve measuring device as disclosed in FIG. 10 of JP-A-2005-59958. When the nerve is less than 40 mN, the stability of the pouring direction or the like in the pouring of the packed material from the package bag could be poor and the elasticity of the package bag body could be also weak and the strength of the package bag itself could be insufficient. While, when it exceeds 300 mN, the non-return function of the whole including the film-shaped one-way pouring nozzle could be deteriorated irrespectively of the lamination structure of the laminate film.

In the flexible package bag according to the invention formed by protruding the film-shaped one-way pouring nozzle from the package bag body having such a film construction, it is desirable that the pouring of a controlled and predetermined quantity can be made smoothly even in repetitive pouring case, so that the re-pouring could be made in the same way as the first pouring is made.

Further, it is preferable that the length of the nozzle opening or pouring edge portion extending in substantially a widthwise direction (up-down direction) of the laminate film is about 5-40 mm irrespectively of the number of layers of the laminate film. The term "substantially a widthwise direction" used herein, as mentioned above, is based on the consideration that the tear direction and hence the extending direction of the nozzle opening edge portion may be inclined at an angle of 0-15° with respect to the width direction of the laminate film. When the length of the nozzle opening portion is less than 5 mm, the pouring quantity is too small in connection with the volume of the package bag body, while when it exceeds 40 mm, the accurate determination of the pouring direction is difficult.

In such a flexible package bag or a package bag formed by integrally uniting the laminate film for the package bag body and the laminate film for the film-shaped one-way pouring nozzle, a step for fusion-joining both the laminate films becomes unnecessary and the independent production of the film-shaped one-way pouring nozzle can be also unnecessary, so that the occurrence of poor joining and the like can be eliminated completely and also the package bag can be manufactured more simply and rapidly and cheaply.

Such a one-piece molding type flexible package bag can function the film-shaped one-way pouring nozzle likewise the previously mentioned separate type package bag in the pouring of the packed material, while after the pouring of the packed material is stopped, the bag can effectively prevent the invasion of ambient air into the inside of the package bag body because the adhesion sealing of the film-shaped one-way pouring nozzle is maintained over the long period under the presence of the liquid packed material.

In the flexible package bag according to the invention, the coating layer of water-repellant material or oil-repellant material is provided on an outer surface of a portion forming at least nozzle opening of the film-shaped one-way pouring nozzle or an outer surface of a predetermined opening portion and its vicinity. When such a treatment is applied to the film-shaped one-way pouring nozzle, so-called liquid cutting property when the package bag is restored to the standing posture to stop the pouring of the packed material can be enhanced to effectively prevent accidental dropping-down of the packed material.

That is, the characteristic construction of the flexible package bag, particularly film-shaped one-way pouring nozzle according to the invention first lies in that the coating layer of water-repellant material or oil-repellant material is provided on at least predetermined opening portion and its vicinity on the outer surface of the nozzle as well as a neighborhood including a lower edge portion of the nozzle.

As the water-repellant material, a water-repellant coating agent made from silicone oil, a fluorine resin, an acrylic resin or an amide resin is used. As the oil-repellant material, an oil-repellant coating agent of a silicone resin, a Teflon resin, a silicon-modified acrylic resin or the like is used. In addition to such a material, a urethane resin, an acrylic resin, an ester resin, a netrocellulose-based resin, an amide resin, a vinyl chloride based resin, a rubbery resin, a styrenic resin, an olefinic resin, a vinyl hydrochlorinate resin, a cellulose resin, a phenolic resin or the like is added as a binder.

The reason why the water-repellant/oil-repellant coating layer is formed in the invention is that such cases can be prevented as when the packed material is, for example, a low viscosity material such as soy sauce or alcoholic beverage and the packed material is poured by gradually tilting the package bag mostly in a square planar shape after the formation of the pouring port so that pouring too much to a food can be avoided, the liquid packed material at a tilted posture of the package bag often drops to an unintended place by running down along the bag's periphery portion located at the lower height level, that is, lower than the formed pouring port and a cloth is sometimes spoiled by the packed material.

In the package bag according to the invention, even when the packed material is a high viscosity material such as oily dressing, salad oil or the like, the oil-repellant layer is disposed on the outer surface of the side portion located downward from the pouring port opened near to the top portion of the film-shaped one-way pouring nozzle in the pouring posture, whereby the liquid cutting property through the oil-repellant layer when the packed material is gradually poured from the pouring port is improved to quickly prevent the wetting of the side portion located downside the package bag with oil or the like, and hence the problem of dropping the viscous liquid to the unintended place can be resolved effectively.

In the invention, the contact angle of the water-repellant/oil-repellant coating layer with the packed liquid such as soy sauce or oil is preferably a range of 100-170°. In this case, the liquid material can be prevented from running around the vicinity of the pouring port effectively to further enhance precision of the pouring direction.

The inventors have examined the influence of presence or absence of water-repellant layer upon the liquid cutting property of the packed material in the flexible package bag according to the invention. There are provided two film-shaped one-way pouring nozzles each made of a lamination structure of a biaxially oriented nylon base film of 15 μm in thickness and a linear-load density polyethylene sealant layer of 50 μm in thickness, one of which being provided with a water-repellant layer formed by applying silicone oil as a coating agent to a lower edge portion from a predetermined opening portion (predetermined line portion of pouring port) of the nozzle toward a side of a package bag body (Invention Acceptable Example) and the other having no water-repellant layer (Comparative Example). A strong soy sauce (made by Kikkoman Corporation) as a packed material is filled into a package bag formed by fusion-joining each of the two film-shaped one-way pouring nozzles to a side portion of a package bag body and then the package bag is fixed to a tilting angle measuring apparatus at a state of a pouring port being opened and the bag is gradually tilted at a rate of 50 mm/min to measure a tilting angle ($\alpha$) of the bag at the time of the packed material being started to be poured.

From the results of Table 1, it can be confirmed that the tilting angle of the bag when the pouring being started is not dependent upon the presence or absence of the water-repellant layer, but the dripping is generated at the tilting angle of the bag when the packed material being started to be poured in Comparative Example, while in the Invention Acceptable Example the dripping can be controlled even at a state of a tilting angle of the bag made steeper (smaller) than the tilting angle of the bag when the packed material being started to be poured by the presence of the water-repellant layer.

TABLE 1

| | Invention Acceptable Example | Comparative Example |
|---|---|---|
| Water-repellant layer | presence (silicone oil) | absence |
| Angle when pouring is started | 71° | 69° |
| Angle when dripping is generated | 55° | 69° |

Secondly, the characteristic construction of the film-shaped one-way pouring nozzle lies in that a wet-treated layer obtained by subjecting to a wet treatment as mentioned later is provided on an inner surface of a pouring path in the film-shaped one-way pouring nozzle or an inner surface of a path made of a sealant layer. By disposing the wet-treated layer on the inner surface of the pouring path in the film-shaped one-way pouring nozzle, the liquid packed material is adhered to the inner surface of the pouring path through a capillary action, whereby the self-sealing non-return function can be developed more surely.

The wetting treatment is a treatment wherein a surface of a sealant film made, for example, of PE, PP, EVA, ionomer or the like in the laminate film is subjected to a wetting treatment such as corona discharge treatment, UV ozone treatment, plasma treatment, flame treatment or the like to improve the wettability of the film through a synergistic effect of physical surface modification of the film surface and chemical surface modification by the formation of polar functional group.

The inventors have also verified the action and effect of the wetting treatment. The results are shown in Table 2. That is, an inner surface of a sealant film in a film-shaped one-way pouring nozzle made of a three-layer laminate structure of LLDPE 15/PET 12/LLDPE 20 is subjected to a corona discharge treatment (discharging condition: discharged quantity 81.7 W·min/m$^2$) and then a wet tension of the inner surface film is measured by using a wetting reagent. As a result, the wet tension is 32 N/m before the wetting treatment while it is 56 N/m after the treatment. Also, contact angle with each of water, soy sauce, ponzu sauce and oil is shown in Table 2, from which the effectiveness of this treatment is confirmed because the aggregation force of liquid or surface tension (S) becomes weak and the contact angle (θ) becomes apparently small to improve the wettability.

TABLE 2

| Corona discharge | Contact angle (θ) | | | |
|---|---|---|---|---|
| treatment | water | soy sauce | ponzu sauce | oil |
| absence | 98 | 83 | 86 | 39 |
| presence | 73 | 66 | 67 | 19 |

*θ: average value of three measured values
Length L of discharge electrode: 0.108 m
Film rate V: 9.6 m/min
Discharge power: 85 W A concrete form of the flexible package bag according to the invention will be described with reference to the drawings below.

FIG. 1 is a plan view of an embodiment of the aforementioned flexible package bag, particularly the film-shaped one-way pouring nozzle. Numeral 1 in the figure is a film-shaped one-way pouring nozzle. This film-shaped one-way pouring nozzle 1 is an example that the film-shaped one-way pouring nozzle 1 is protruded, for example, from an upper part of a left-side edge in a package bag body 2 made from a soft laminate film. An outermost sealant layer at a base end portion of the film-shaped one-way pouring nozzle 1, or preferably a sealant layer made from the same resin material as the sealant layer of the package bag body 2 is fusion joined to a sealant layer at the inner surface side of the bag body 2 through heat-sealing.

As the case may be, a sealant resin at the side the inner surface of the pouring path could be a resin of a high melting point and it is preferable that a portion corresponding to the fusion-joined portion between the bag body 2 and the film-shaped one-way pouring nozzle 1 is temporarily fused at a low temperature to form a temporary sealing portion 12.

The film-shaped one-way pouring nozzle 1 can be constructed by mutually fusing a pair of front-side and rear-side disposed three-layer laminate plastic film, each of which comprising a thermoplastic base film layer such as biaxially oriented PET or NY layer of 5-40 μm, preferably 10-30 μm in thickness and sealant layers laminated on both surfaces of the base film layer such as non-oriented PE or PP layer of 5-80 μm, preferably 10-60 μm in thickness, i.e. a pair of front and rear laminate plastic films having the same profile form such as wedge form or the like or by folding the single laminate plastic film at its central portion toward front and rear sides to each other as shown by oblique lines in the figure so as to join side portions other than a base end side at an opposite postures of sealant layers at the inner surface side, preferably through heat sealing.

As shown in FIG. 1, it is preferable that the film-shaped one-way pouring nozzle 1 is provided at a predetermined tear-opening position of an upper edge portion of the nozzle with tear guide perforations 1*a* comprising opening means such as I-notch, V-notch, U-notch, base notch, diamond cut or the like. The nozzle is made to be used by opening the tear guide perforations 1*a*.

Figure 2:
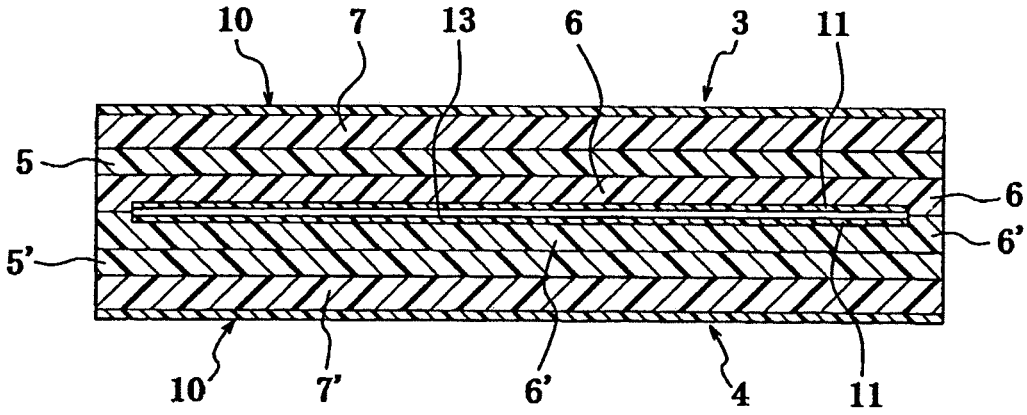
FIG. 2 is an enlarged section view of a predetermined position of an opening in a film-shaped one-way pouring nozzle.

The film-shaped one-way pouring nozzle 1 can be manufactured simply and quickly by mutually fusing front and rear laminate plastic films 3,4 as shown in FIG. 2 by an enlarged section view taken along a III-III line of FIG. 1 in a widthwise direction of the nozzle, each having a three-layer structure comprising base film layers 5, 5' and sealant layers 6, 6', 7, 7' laminated on both surfaces of the base film layer 5, 5' so that the sealant layers 6, 6' facing to each other at the inner surface sides can be fused in their peripheral portions other than a base end side at a given width, for example at a width of 0.5-3.0 mm, preferably 1.0-2.0 mm so as to be shaped into a required form (wedge form) through, preferably, heat sealing.

It is preferable that the film-shaped one-way pouring nozzle 1 is formed by laminating flat sheets as far as possible for giving the excellent non-return function.

At the base end portion of the nozzle, the sealant layers 7, 7' located at the outer surface side are fused to the inner surface of the package bag body 2 (sealant layers) through, preferably, heat sealing, whereby the nozzle can be joined to the package bag body 2 adequately, surely and simply.

Figure 3:
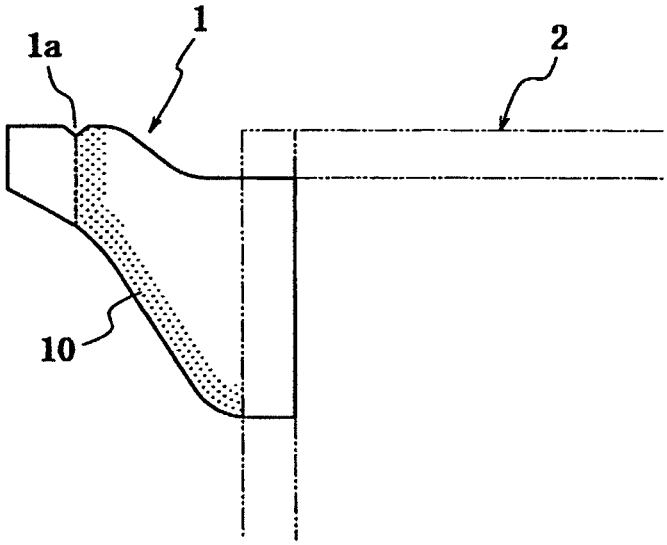
FIG. 3 is a front view illustrating a state of disposing a coating layer on a film-shaped one-way pouring nozzle.

As shown in FIG. 3, the characteristic structure of the invention applied to the film-shaped one-way pouring nozzle 1 lies in that a coating layer of a water repellant agent or an oil repellant agent (water-repellant, oil-repellant coating layer) 10 for preventing liquid dripping to improve liquid cutting property is provided on the outer surface or an outer surface extending from the predetermined tear lines (predetermined opening portion) of the outer sealant layers 7, 7' toward the side of the base end portion along at least opening end and lower edge portion.

Figure 4:
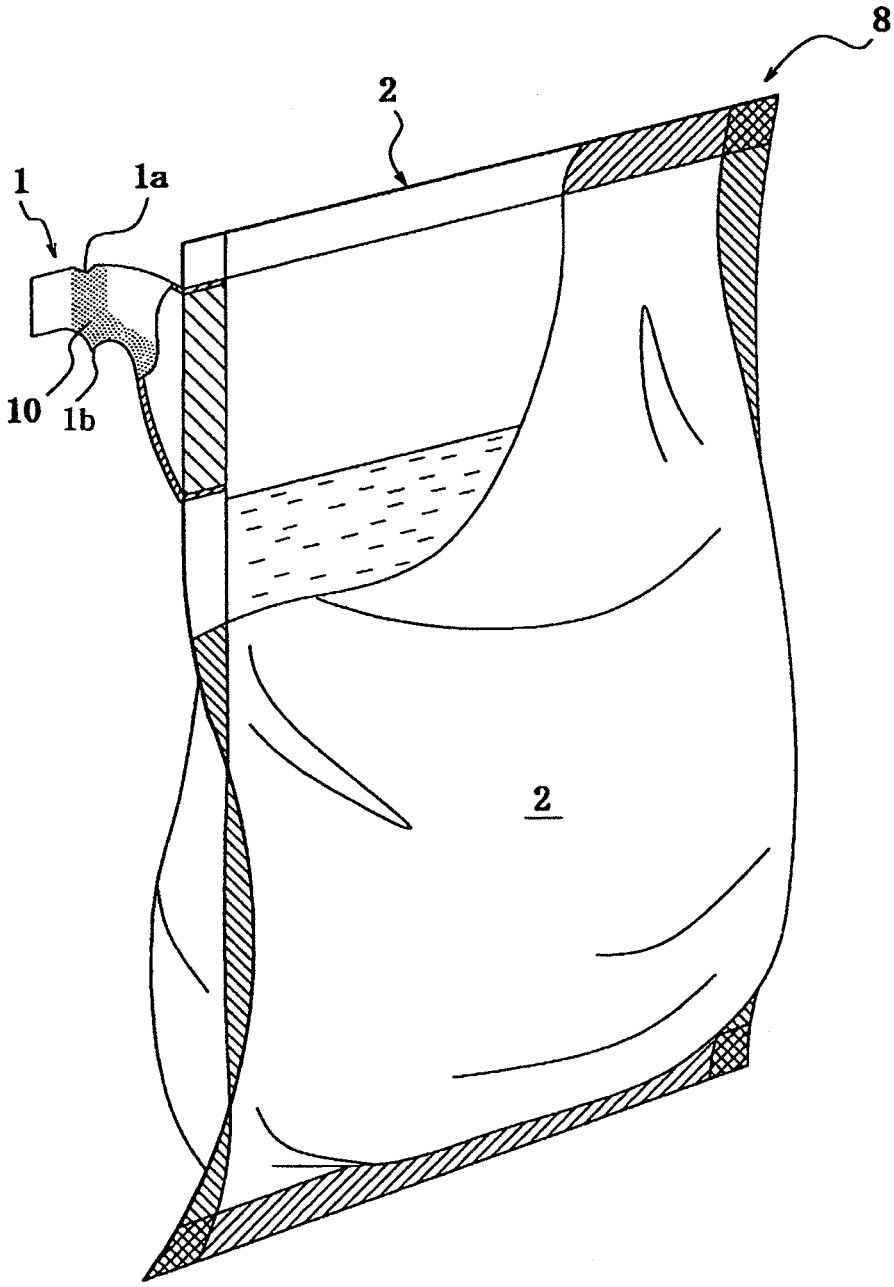
FIG. 4 is a perspective view illustrating an embodiment of the liquid-filled packaging body according to the invention.

Besides, as shown in FIG. 4, a spiry projection 1*b* for prevention of liquid dripping is preferably disposed at a position somewhat biased from the predetermined opening position of the lower edge portion of the film-shaped one-way pouring nozzle 1 toward the base end portion of the nozzle. This projection 1*b* can more effectively prevent the liquid dripping generated at the opening end of the one-way pouring nozzle from running down from the lower edge portion of the one-way pouring nozzle 1 to the package bag body 2.

Further, a wet-treated layer 11 for promoting the non-return function is disposed on the inner surfaces of the inner sealant layers 6, 6' in the film-shaped one-way pouring nozzle 1, particularly the inner surfaces of portions forming the pouring path 13.

For example, the film-shaped one-way pouring nozzle 1 having the above construction is formed to be a part of the package bag by making sealant layers 7, 7' located at the outer surface side of base end portion of the nozzle 1 to be fusion-joined preferably through heat sealing to the inner surface side of the package bag body 2, which is the fusion-joining portion of each sealant layer being mutually fused at and also the side portion of the deaeration-packing of the package bag body 2 or the like, at the same time or prior to when the packing material being deaeration-packed into the package bag body made of soft laminate films through in-liquid seal packing. As shown in FIG. 1, the nozzle is laterally protruded from the upper end portion of the package bag body 2.

Moreover, in the liquid-filled packaging body 8, according to the invention, it is required that the liquid packing material is deaeration-packed through in-liquid seal packing or the like so as not to leave gas in the bag for developing the self-seal non-return function of the film-shaped one-way pouring nozzle 1.

At this stage, the sealant layer forming the inner surface of the soft package bag body 2 is preferably made from the same resin material as the sealant layer in the outer surface of the film-shaped one-way pouring nozzle 1 for enhancing the fusion strength.

As the film construction of the package bag body 2, if properties required in the package bag can not be ensured only by the sealant layer and the base film layer, it is also possible to interpose a middle layer between the layers.

Figure 5:
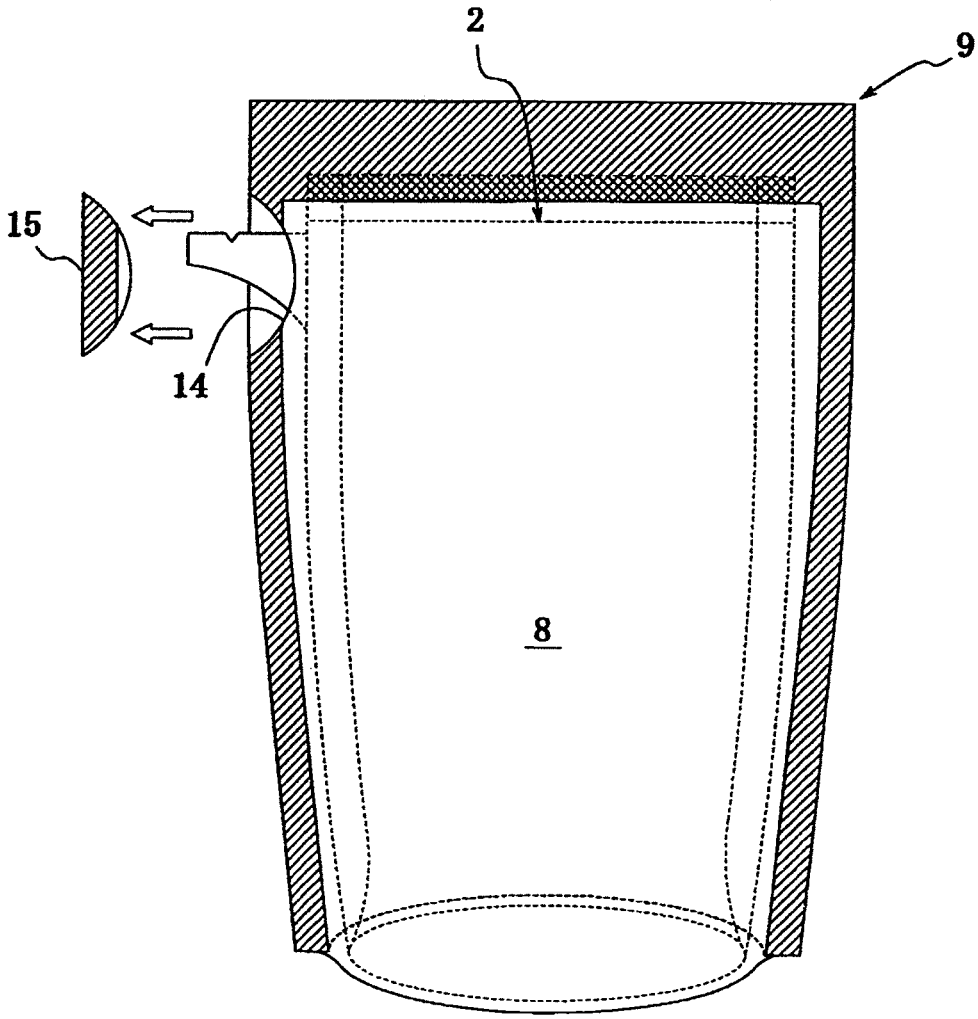
FIG. 5 is a front view illustrating an embodiment of the liquid-filled packaging structure according to the invention.

The liquid packing material is dearation-packed into such a flexible package bag, preferably, through the in-liquid seal packing to form the liquid-filled packaging body 8 of a distended form as shown in FIG. 4. However, the soft, flexible package bag itself typically has neither of a self-standing property nor a fixing property, so that it is preferable that the bag is housed in a self-standing outer package bag 9 or a standing pouch 9 as shown in FIG. 5 and mentioned in detail later to bring about the self-standing property and the fixing property so as to be used for transporting, storing, displaying, using the packing material and the like.

In this case, the pouring is carried out by increasing a tilting angle of the self-standing type outer package bag (mentioned in a case of "standing pouch" hereinafter) 9 as the packed material in the bag is reduced.

The use of the flexible package bag is conducted by tearing or cutting the top end side of the predetermined tear portion of the film-shaped one-way pouring nozzle 1 to obtain the nozzle opening or pouring port and then pouring the liquid packing material inside the flexible package bag from the pouring port formed in the film-shaped one-way pouring nozzle 1 at a posture of tilting the standing pouch 9 without invasion and suction of ambient air. On the other hand, the invasion of ambient air into the inside of the package bag body 2 is surely obstructed by restoring the standing pouch 9 to the standing position to stop the pouring and closely adhering the whole inner surfaces of the film-shaped one-way pouring nozzle 1 in the presence of a liquid film made from the liquid packing material wetting the inner surfaces.

Thus, the package body obtained by deaeration-packing the liquid packing material into the package bag body 2 through in-liquid seal packing can pour the packing material without taking ambient air into the inside of the package bag body 2 as the package bag is shrunk or collapses to be deformed by the amount corresponding to the pouring amount of the packing material.

After the pouring of the packing material is stopped, the invasion of ambient air into the package bag body 2 is prevented by the closing seal of the inner faces in the pouring path of the film-shaped one-way pouring nozzle 1 owing to its non-return function, whereby contamination, oxidation or the like of the packing material retaining in the package bag body 2 through ambient air can be prevented sufficiently.

After the required quantity of the liquid packing material is poured, the pouring port located at the top portion of the film-shaped one-way pouring nozzle 1 is automatically closed, and the standing pouch as a self-standing type outer package bag is restored to the standing posture under such a state.

As previously mentioned, the closing seal of the film-shaped one-way pouring nozzle 1 producing the non-return function is conducted by releasing the film-shaped one-way pouring nozzle 1 from water head pressure to restore the front and rear laminate films 3, 4 to the original form in the production of the film-shaped one-way pouring nozzle 1 and placing the front and rear plastic films 3, 4 in an atmosphere of a reduced pressure when the packing material inside the film-shaped one-way pouring nozzle 1 is flown back to the package bag body 2 to thereby adsorb the inner surfaces (sealant layers 6, 6') of the soft plastic films 3, 4 to each other through a capillary action of the liquid packing material over a full nozzle width in the presence of the liquid packing material attached to these surfaces, and so on.

The mutual closing between the films based on such a self-seal non-return function is maintained more surely when the package bag body 2 after the collapsing to be deformed or the like tends to reduce the interior of the package bag body 2 based on its elastic restoring force.

In the film-shaped one-way pouring nozzle 1 used in the invention, it is preferable that the outer sealant layer has a low melting point and the base end portion of the outer sealant layer is fusion-joined to the inner sealant layer of the package bag body 2 at a posture of protruding from the side portion of the soft package bag body 2, mostly from the side portion of its upper end part, while the inner sealant layer of the film-shaped one-way pouring nozzle 1 has a high melting point and forms a temporarily sealed portion 12 in a state of temporarily fusing at a relatively low temperature and at an adhesion strength corresponding to a half or less than of its heat-sealing strength, for instance, when the base end portion of the one-way pouring nozzle 1 is fusion-joined to the inner surface of the package bag body 2.

At this moment, the temporarily sealed portion 12 through a low-temperature temporary fusion can be realized by reducing at least one of a heating temperature, pressurizing pressure and pressurizing time in the heat-sealing means as compared with the case of forming a complete fusion-joint portion.

In the formation of the temporarily sealed portion 12, the forming position may be a position corresponding to a fusion-joining position of the film-shaped one-way pouring nozzle 1 to the package bag body 2 but also may be a position somewhat biased from the corresponding position toward the inside of the package bag body 2 or inversely a position somewhat biased from the corresponding position toward the outside of the package bag body. In any cases, it is necessary that a portion forming the pouring path for the packing material and having a length (about 5-8 mm) enough to develop the function inherent to the film-shaped one-way pouring nozzle is retained outside the low-temperature temporarily fused portion or temporarily sealed portion 12.

Further, in the formation of the temporarily sealed portion 12, it is required to use a high melting point sealant layer and a low melting point sealant layer in the film-shaped one-way pouring nozzle 1, but these sealant layers are preferably made from a low density polyethylene containing a straight, low density polyethylene, or it is preferable that the high melting sealant layer is made from a middle density or high density polyethylene and the low melting sealant layer is made from a low density polyethylene.

Even when each of the high melting sealant layer and low melting sealant layer is made from a low density polyethylene, or when the high melting sealant layer is made from a middle density or high density polyethylene and the low melting sealant layer is made from a low density polyethylene, the temporary sealing having a sealing strength as is expected and the fusion joining required in the film-shaped one-way pouring nozzle 1 can be realized simply and easily.

When the high melting sealant layer is made from a straight-chain, low density polyethylene, a low density polyethylene or a middle density polyethylene, the fusion-joining strength inherent to the film-shaped one-way pouring nozzle can be enhanced sufficiently.

Moreover, the selection of high and low melting points in the same material of polyethylene can be realized, for example, by mutually changing extrusion laminating conditions and the like in the lamination of the sealant layers.

The temporarily sealed portion 12 as mentioned above is disposed in the base end portion of the film-shaped one-way pouring nozzle at the fusion-joining position of the film-shaped one-way pouring nozzle 1 to the package bag body 2 or its vicinity. Thus, the flowing of the liquid packing material filled in the package bag toward the top of the nozzle from the temporarily sealed portion 12 is prevented surely. Even if the packing material is heated to 50-100° C., a greater part of the pouring path for the packing material in the film-shaped one-way pouring nozzle 1 is sufficiently protected from the permanent deformation of inflating the pouring path.

Therefore, the top portion from the temporarily sealed portion 12 in the film-shaped one-way pouring nozzle 1 can always develop the function of the film-shaped one-way pouring nozzle sufficiently. That is, when the packing material is poured from the package bag, the invasion of ambient air into the interior of the package bag body can be prevented sufficiently, while the self-seal non-return function at the pouring of the packing material being stopped can be surely developed.

When the packing material after the cooling to about room temperature in the bag is poured from the package bag, the temporarily sealed portion 12 is opened, for example, by applying a load to the package bag in a thickness direction and also at the same time by breaking or cutting the top end portion of the film-shaped one-way pouring nozzle to form a pouring port, and the package bag is tilted under such a state to render the pouring port into a downward directing posture.

Moreover, the fusion-joined portion of the package bag other than the temporarily sealed portion 12 is heat-sealed at a strength higher by 2 times or more than that of the temporarily sealed portion 12, so that accidental breakage is never caused even when a load required for opening the temporarily sealed portion 12 is applied to the bag.

Moreover, another example of the package bag provided with the film-shaped one-way pouring nozzle according to the invention may be a structure that front and rear laminate films each comprising a base film layer and a sealant layer laminated to one-side surface of the base film layer directly or indirectly through one or more middle layers, for example, these front and rear laminate films or single laminate film folded at its central portion into front and rear sides are fusion-joined at a posture of making the sealant layers to face each other to form a film-shaped one-way pouring nozzle and the resulting nozzle is integrally united with a soft package bag body at a posture of protruding from the side portion of the bag body, typically a side portion of an upper end part of the bag body, while the sealant layers at the inner surface of the nozzle are fused at a low temperature in a base end of the film-shaped one-way pouring nozzle protruding from the soft package bag body to form a temporarily sealed portion. Even in this package bag, the unintended invasion of ambient air into the package bag body can be prevented sufficiently either when the liquid packing material is poured from the package bag or when the pouring is stopped.

In this package bag and the previously mentioned package bag, the heat-sealing strength of the temporarily sealed portion 12 is preferably within a range of 0.3-3 (N/15 mm), particularly 0.7-1 (N/15 mm) so that the accidental opening of the temporarily sealed portion 12 can be prevented and also the temporarily sealed portion 12 is nonrandomly opened without exerting any force on the other fusion-joined portion.

When the heat-sealing strength is less than 0.3 (N/15 mm), the temporarily sealed portion 12 could be opened accidentally in connection with the volume and the like of the liquid packing material in the bag at a heating state, while when it exceeds 3 (N/15 mm), the load required for the opening of the temporarily sealed portion 12 could be accidentally exerted upon the other fusion-joined portion and so on (to be broken or opened).

The load for opening the temporarily sealed portion 12 is preferably 50-350 (N), particularly 80-300 (N), most preferably 100-200 (N), which does not cause the breakage of other places including the sealed portion and also prevents the portion from being accidentally opened in the transportation or operation.

When the opening load is less than 50 (N), the temporarily sealed portion 12 could be opened at a lower stage side package bag when package bags each filled with the packing material are piled one upon the other. When it exceeds 350 (N), or when the heat-sealing strength is too high, the other fusion-joined portion could be affected by the load required for opening the temporarily sealed portion 12.

According to the inventors' studies, for instance, a base end portion of a film-shaped one-way pouring nozzle 1 as shown in FIG. 1 is temporarily sealed by a low-temperature temporary fusion to a side portion of an upper part of a soft package bag body 2 (NY 15 μm/PET 12 μm/LLDPE 40 μm). A plastic film laminate structure of the film-shaped one-way pouring nozzle 1 is straight-chain low density polyethylene layer (low melting point sealant layer)/biaxially oriented polyethylene terephthalate layer/straight-chain low density polyethylene layer (high melting point sealant layer). The heat-sealing strength (N/15 mm) of the temporarily sealed portion when the plastic laminate film is heated and pressurized by means of a heat sealer provided with a cylinder under a cylinder pressure of 300 kPa for 3 seconds using the heat-sealing temperature as a parameter is measured by a tensile testing machine (TENSILON RTG-1300) under conditions that a tensile rate is 200 mm/min and a film width is 15 mm. The results are shown in Table 3.

TABLE 3

| Sealing temperature (° C.) | 106 | 108 | 110 | 112 | 114 | 116 |
|---|---|---|---|---|---|---|
| Average sealing strength (N/15 mm) | 0.27 | 0.36 | 0.44 | 0.64 | 1.79 | 4.61 |

* Measuring method: according to JIS E0236 (1996)

Then, the invention proposes a back-in-pouch type liquid-filled packaging structure constituted by making a non-self standing type liquid-filled packaging body 8 formed by filling a liquid or viscous packing material through in-liquid seal-packing in the aforementioned flexible package bag of no self-standing property nor fixing property with the film-shaped one-way pouring nozzle being protruding from, to be housed in a self-standing type package bag comprising a soft laminate film with tear guide perforations for nozzle opening at the upper side portion of the bag corresponding to the protruding position of the film-shaped one-way pouring nozzle so that the film-shaped one-way pouring nozzle can be pulled out.

In the liquid-filled packaging structure according to the invention, the self-standing type package bag 9 (so-called standing pouch) is made, for example, of a laminate film comprising a uniaxialy or biaxially oriented base film layer and a sealant layer, and is preferably made of a soft laminate film comprising a polyethylene terephthalate film layer or a nylon resin film layer as a base film and a polyethylene layer or a polypropylene layer as a sealant layer.

The self-standing type package bag 9 is provided with any opening perforations at its one side portion or at a position of the liquid-filled packing body 8 housed inside, corresponding to the film-shaped one-way pouring nozzle 1, such as I-notch, V-notch, base notch, diamond cut or the like and also provided with cut-guide perforations 14 capable of cutting into an arc form as shown in FIG. 5 as well as with a cut portion 15 for exposing the film-shaped one-way pouring nozzle 1. By cutting the cut portion 15, the protruding portion of the film-shaped one-way pouring nozzle (usually folded to an extent not bending and housed in the standing pouch) protruding from the non-standing type flexible package bag or liquid-filled packing body 8 can be pulled out. The cutting-out state is shown in this figure.

In the invention, the liquid-filled packing body 8 is housed in the standing pouch 9 and the interior of the standing pouch might be deareated weakly and at the same time an upper part of the pouch 9 is sealed (or may be chucked), whereby the liquid-filled packing body 8 filled with the liquid material can be held at a state of firmly fixing inside the standing pouch 9. In this case, therefore, the liquid-filled packing body 8 can be sufficiently protected against various impacts in the handling or distribution and the position shifting of the liquid-filled packing body 8 is not caused so that the occurrence of the pinholes or the like and the deformation, breakage or accidental opening of the film-shaped one-way pouring nozzle can be prevented.

After the liquid-filled packing body 8 is housed in the standing pouch 9, one or more places, in the vicinity of the film-shaped one-way pouring nozzle 1, particularly in the vicinity of its lower side portion or of the upper portion, or in the upper portion of the package bag body, are preferably fixed so that the liquid packed material can be poured smoothly and completely until the end.

Particularly, as shown in FIG. 5, it is preferable that at least a part of the upper edge portion (lateral sealing portion) of the liquid-filled packing body 8 is fused to the lateral sealing portion of the self-standing type package bag 9, whereby the liquid-filled packing body 8 is housed in the self-standing type package bag 9 at a suspended state, which is effective for ensuring the smooth pouring of the packed material at any time.

Industrial Applicability

The technique of the invention is applicable to not only the package bag provided with the film-shaped one-way pouring nozzle but also general liquid-filled packing bodies, particularly a package structure hosing a refill soft package bag provided with a general liquid pouring port integrally formed within the package bag body.

The invention claimed is:

1. A liquid-filled packaging structure comprising a non-self supporting type liquid-filled packaging body formed by deaeration-packing of at least one of a liquid and a viscous packing material into a non-self supporting type flexible package bag comprised of a package bag body formed by seal-joining front-side and rear-side soft laminate films and a film-shaped one-way pouring nozzle which is protruded from any position of a side portion, a corner portion and a top portion of the package bag body having a non-return function that blocks penetration of air generated by a closing action between mutual inner surfaces of the soft plastic films when the packing bag body is tilted to pour a liquid packing material and the pouring path is rendered into a wet state by a liquid material passing through the path to attach the liquid packing material to the inner surface of the pouring path and provided on an outer surface with a coating layer made from at least one of a water-repellant material and an oil-repellant material and on an inner surface of a predetermined opening position and a vicinity of the predetermined opening position within a portion of a pouring path with a wet-treated layer, and a spiry projection that prevents dripping of liquid, the spiry projection provided at a position intermediate a predetermined opening position of a lower edge portion of the film-shaped one-way pouring nozzle and the base end portion of the film-shaped one-way pouring nozzle, and a self-supporting type outer cylindrical flexible package bag made of a soft laminate film for housing the non-self supporting type liquid-filled packaging body which is provided with tear-guide perforations at one-side portion thereof for opening the nozzle to expose a tip portion of the film-shaped one-way pouring nozzle, and a horizontal seal portion provided at an upper end part of the non-self supporting type liquid-filled packaging body being fused to an upper end portion of the self-supporting type outer cylindrical flexible package bag such that the non-self supporting type liquid-filled packaging body is housed and supported within the self-supporting type outer cylindrical flexible package bag in a suspended state.

2. The liquid-filled packaging structure according to claim 1, wherein the film-shaped one-way pouring nozzle is formed by fusing a pair of overlapping soft plastic films to each other at a peripheral edge portion other than a portion corresponding to a base end portion of the film-shaped one-way pouring nozzle so as to constitute a central portion of the film-shaped one-way pouring nozzle as a pouring path and is integrally united with the main body of the package bag.

3. The liquid-filled packaging structure according to claim 1, wherein the film-shaped one-way pouring nozzle is formed by fusing a pair of overlapping soft plastic films to each other at a peripheral edge portion other than a portion corresponding to a base end portion of the film-shaped one-way pouring nozzle so as to constitute a central portion of the film-shaped one-way pouring nozzle as a pouring path and fusion-joining the base end portion of the film-shaped one-way pouring nozzle to a side portion of the main body of the package bag.

4. The liquid-filled packaging structure according to claim 1, wherein at the base end portion of the film-shaped one-way pouring nozzle, opposite sealant layers of the overlapping soft plastic films are temporarily fused at a lower temperature to temporarily seal the inner surface of the pouring path.

5. A liquid-filled packaging structure according to claim 1, wherein the coating layer made from at least one of the water-repellent material and the oil-repellent material is arranged at least in the predetermined opening position of the film-shaped one-way pouring nozzle and a vicinity of the predetermined opening position.

6. The liquid-filled packaging structure according to claim 1, wherein the non-self supporting liquid-filled packaging body is housed and kept in the self-supporting type outer package bag at a suspended state by fusing a horizontal seal portion at an upper end part of the packaging body to an upper end portion of the outer package bag.

* * * * *